US005259078A

United States Patent [19]

Crandall

[11] Patent Number: 5,259,078

[45] Date of Patent: Nov. 9, 1993

[54] POOL COVER

[75] Inventor: Gary M. Crandall, Cortland, Ohio

[73] Assignee: Cantar Corporation, Youngstown, Ohio

[21] Appl. No.: 758,127

[22] Filed: Sep. 12, 1991

[51] Int. Cl.[5] ..... E04H 4/10

[52] U.S. Cl. ..... 4/503; 4/498

[58] Field of Search ..... 4/498, 503, 506

[56] References Cited

U.S. PATENT DOCUMENTS

| | | | |
|---|---|---|---|
| 2,958,872 | 11/1960 | Meyer, Jr. | 4/503 |
| 3,184,764 | 5/1965 | West | 4/498 |
| 4,011,607 | 3/1977 | Davidoff | 4/503 |
| 4,192,025 | 3/1980 | Hinsperger | 4/498 |
| 4,233,695 | 11/1980 | Rowney | 4/498 |
| 4,628,549 | 12/1986 | Lazar | 4/498 |
| 4,916,763 | 4/1990 | Christensen | 4/503 |
| 5,014,369 | 5/1991 | Daus | 4/503 |
| 5,025,513 | 6/1991 | Weissner | 4/498 |

FOREIGN PATENT DOCUMENTS

| | | | |
|---|---|---|---|
| 471470 | 3/1974 | Australia | 4/503 |

*Primary Examiner*—Robert M. Fetsuga

*Attorney, Agent, or Firm*—Griffin Butler Whisenhunt & Kurtossy

[57] ABSTRACT

A swimming pool cover for covering the entire area of a water-filled pool so as to prevent egress of silt and debris into the pool during periods of non-use comprises a water-impervious sheet material configured to extend across the entire area of the pool. A securing strap is attached at spaced-apart positions near edges of the sheet material for securing the sheet material in a taut condition to pool outer portions. An anchor is disposed in the pool outer portions for anchoring the securing strap in a manner to provide the taut condition of the sheet material. A resilient attachment, such as a spring, attaches the securing strap to the anchor so as to ensure the maintenance of the taut condition. At least one aperture is disposed in the sheet material at a lowermost portion thereof. A filter is attached along and near peripheral edges of the aperture and the filter has pore sizes sufficient to be impervious to silt and debris but pervious to water. Thus, silt and debris are prevented by the filter from entering the pool. Water from snow or rain may enter the pool through the filter so as to keep the impervious sheet material from being weighted down and sinking under the surface of water.

18 Claims, 2 Drawing Sheets

POOL COVER

The present invention relates to a swimming pool cover and, more particularly, to such a cover for preventing egress of silt and debris into a pool during periods of non-use of the pool.

BACKGROUND OF THE INVENTION

The art has provided a number of different swimming pool covers, but, generally speaking, these covers can be divided into two major categories. The first category is that of Summer covers, and the second category is that of Winter covers. Summer covers are, generally, used to cover the surface of the pool during the swimming season, so as to conserve the heat of the water in the pool, especially during the cooler Spring and Fall swimming days. These covers are, generally speaking, made of "bubble" plastic film, such that there are cells of air sealed between two films of plastic, and those cells provide sufficient buoyancy that the cover will float on the surface of the water in the pool. During cooler days, especially, in the Spring and Fall, sunlight will pass through those Summer covers and be absorbed by the water in the pool, thus heating the pool. Summer covers also prevent heat loss from the surface of the water during cool evenings and nights, especially in the Spring and Fall, and thus conserve the heat of the water in the pool. For this latter reason, these Summer covers are often referred to as "pool blankets."

Such Summer covers are, therefore, impervious to water, and during periods of rain, water may collect on Summer covers. However, since those Summer covers are not attached to the sides of the pool in any substantial way, water collected on the Summer covers simply spills over the edges of the covers into the pool, and thus Summer covers remain in a condition such that they will float on the surface of the water in the pool.

However, any silt or debris which accumulates on Summer covers will also spill off of the Summer cover and into the pool. This is not normally a difficulty, since during the swimming season, the pool must be routinely cleaned, and such silt and debris are removed during that cleaning.

The second category of pool covers, i.e. Winter covers, are intended for covering the pool during periods of non-use, i.e. from the Fall and into the following Spring. These covers serve very different purposes from Summer covers, and the functions, characteristics and uses of Winter covers are substantially different from that of Summer covers and form a very distinct cover from that of a Summer cover. A Winter cover has two primary purposes. The first purpose is that of keeping silt and debris, e.g. fallen leaves, twigs, grass cuttings, etc., from entering the pool, since, during the Winter season when the pool is not routinely cleaned, that debris can cause serious cleanliness problems in the water of the pool. The second purpose is that of preventing accidental entry into the pool by children, pets and the like. For this reason, Winter covers are often referred to as "safety" covers. While these Winter covers, in an emergency, can support the weight of a pet or child or even an adult, they are not intended to be walked upon, and that safety feature is intended only for emergency purposes, e.g. where a child may accidentally fall into the pool.

Thus, Winter covers differ from Summer covers in three main aspects. Firstly, the Winter covers must be quite sturdy in order to prevent a child or pet, for example, from accidentally falling into the pool water. Secondly, the Winter covers must be capable of substantially reducing the amount of silt and debris which can enter the pool during the Winter months. Thirdly, the Winter covers must be securely anchored to the outer portions of the pool, as opposed to Summer covers where no such anchoring is normally needed.

In the prior art, Winter covers have usually been made with a tightly-woven mesh, such as a tightly-woven olefin fiber mesh, and that mesh is disposed over the area of the pool and to at least outer portions of the pool, e.g. the coping of the pool. The mesh is very strong and is further strengthened by a series of straps which traverse the length and breadth of the mesh, providing a gridwork for further support of the cover, in the event that a child or animal falls into the pool. Those straps are anchored at the outer portions of the pool in spaced-apart anchoring positions.

During the Winter, when rain or snow falls, the mesh allows the water of the rain or snow to pass therethrough. This prevents water accumulation on the tautly secured Winter cover, and, thus, prevents the Winter cover from being weighted down and sinking beneath the surface of the water in the pool. Of course, if the cover sank beneath the surface of the water in the pool, any silt or debris that collected on the pool would mix with the water in the pool and defeat the purpose of the Winter cover. Further, the "safety" feature would be destroyed.

While these prior art Winter covers work quite well, especially in providing security for the pool and in preventing large debris from entering the water of the pool, they also suffer from a substantial disadvantage. In this regard, while the mesh of the Winter cover is relatively tightly woven in order to provide security for the pool and prevent large debris from entering the pool, the woven mesh is quite porous so as to prevent water accumulation thereon. This porous mesh allows fine debris, e.g. fine pieces of leaves, and, especially, silt, to enter the water of the pool. Over the course of the Winter, the amount of such small debris and silt can substantially degrade the quality of the water in the pool.

It would, therefore, be of considerable advantage to the art to provide a Winter cover which has the security of the prior art covers, but which at the same time prevents egress of all debris, including fine debris and silt, into the water of the pool during use of the Winter cover.

BRIEF DESCRIPTION OF THE INVENTION

The present invention is based on several primary and secondary discoveries. Firstly, it was found that even with the tightest mesh available, small sizes of debris, and especially silt, will pass through that tightest mesh, and some substantial degrading of the quality of the water in the pool, during the Winter season, will take place. Subsidiarily, it was found that in order to prevent such small debris, and especially silt, from entering the water of the pool, the Winter cover must be impervious to water, in order to prevent water from rain or snow from carrying that silt and small debris through the cover and into the water of the pool.

However, with an impervious cover, it was found that some means must be provided for relieving the accumulation of water from rain or snow on the cover. To this end, it was found that an aperture could be placed in a lowermost portion of a cover made of an impervious sheet material and that the water of rain or snow would flow to that lowermost portion and enter the pool, thus, preventing an accumulation of water on the cover and preventing the cover from being weighted down and sinking beneath the surface of the water in the pool. As a further primary discovery, it was found that such an aperture must be protected from entrance of debris and silt, and in this regard, it was found that such protection could be provided by placing a filter at such an aperture, and, when the filter is chosen, especially of certain micron pore size, that filter is quite effective in filtering from the water of rain or snow any silt or debris, so that the water actually entering the water of the pool will be substantially free of such debris and silt.

Further, subsidiarily, it was found that in order to ensure that the aperture and filter are actually positioned in the lowermost portion of the cover during the time the cover is deployed on the pool, the cover must be in a taut condition when deployed over the pool. That taut condition, if maintained during deployment, provides a natural drape of the cover, and that natural drape will automatically provide a lowermost portion where the aperture and filter must be positioned. Thus, again, subsidiarily, it was found that adequate anchoring an attachment means for the cover must be provided to ensure that taut condition of the cover during the time of deployment over the pool.

Thus, very briefly stated, the present invention provides a swimming pool cover for covering the entire area of a water-filled pool so as to prevent egress of silt and debris into the pool during periods of non-use of the pool. The cover comprises a water impervious sheet material configured to extend across the entire area of the pool. Securing means are attached at spaced-apart positions near the edges of the sheet material for securing the sheet material in a taut condition to the pool outer portions. Anchor means are disposed in the pool outer portions for anchoring the securing means in a manner to provide that taut condition of the sheet material. Resilient attachment means are provided for attaching the securing means to the anchor means so as to ensure a taut condition of the cover. At least one aperture is disposed in the sheet material with the at least one aperture being near a lowermost portion of the sheet material when the sheet material is in the taut condition over the pool. A filtering material is attached along and near peripheral edges of the aperture, and the filter material has a pore size sufficient to be impervious to silt and debris, but pervious to water. Therefore, such silt and debris are prevented by the filter from entering the pool while water from snow or rain may enter the pool through the filter so as to keep the impervious sheet material from being weighted down by that water and sinking under the surface of the water in the water-filled pool.

DETAILED DESCRIPTION OF THE INVENTION

Figure 1:
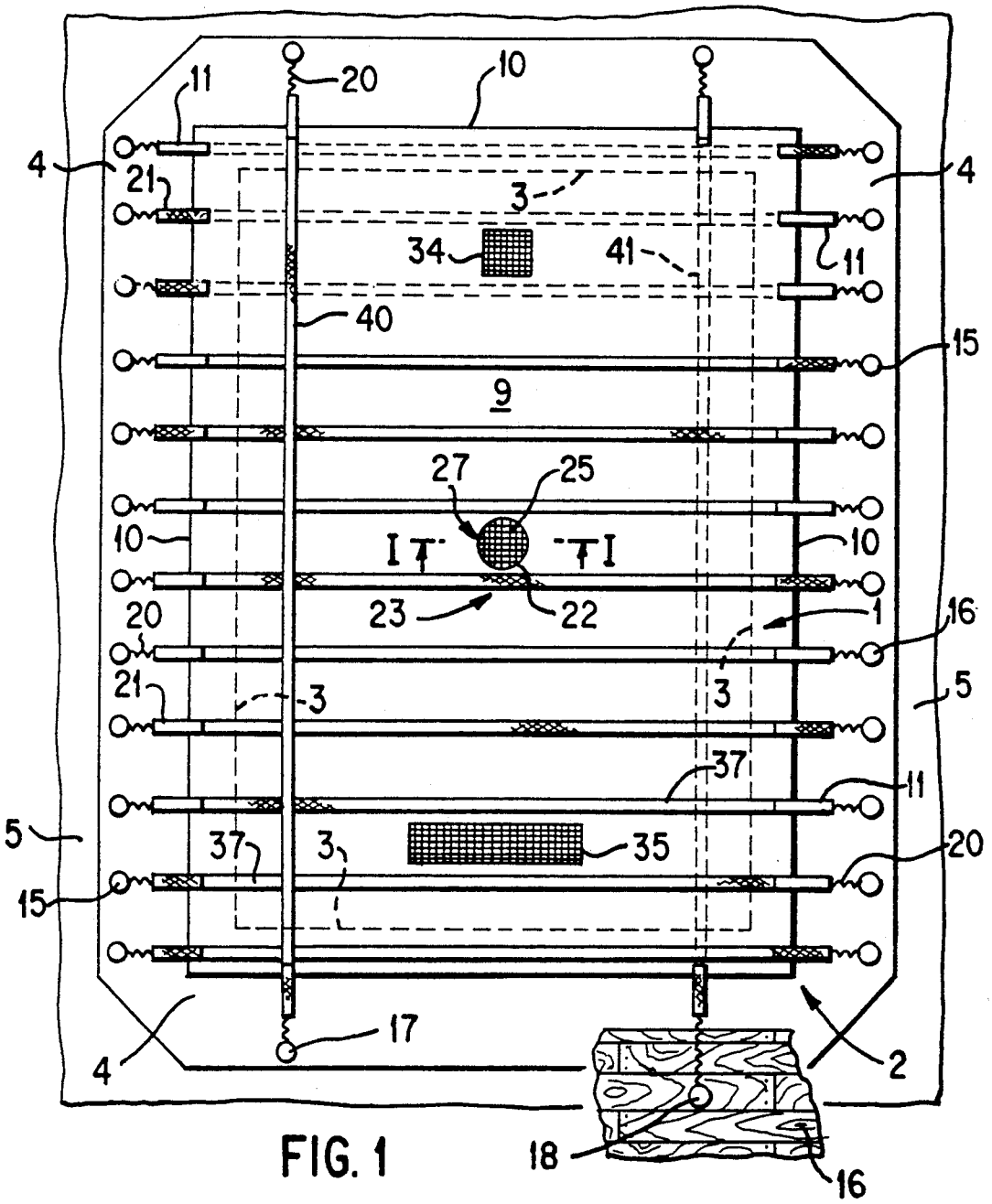
FIG. 1 is a top view of the present pool cover deployed on a typical pool.

The present overall invention may best be understood from FIG. 1, where 1, generally, is the present pool cover. That pool cover extends over the entire area of a water-filled pool, generally, 2 having side walls 3, copings 4, a deck 5 and, optionally, tracks or supports. Some pools have tracks disposed along edges of a pool for motorized deployment of, especially, Summer covers, and those tracks may be anywhere on those outer portions. Pools, of course, may be configured without all of the foregoing. For example, many pools will have no deck or supports or tracks, while some pools may have a coping and a support with no deck. Irrespective of the configuration, for purposes of the present specification, the term "pool outer portions" is intended to refer to either the coping or the deck or the supports, or the tracks, or all, as an individual pool may be configured.

Pool cover 1 is made of a water-impervious sheet material, generally 9, which sheet material is configured to extend across the entire area of the pool and preferably at least to a portion of the pool outer portions, e.g. copings 4, so as to cover the water in the pool and the edges of the pool and to prevent egress of silt and debris.

Near edges 10 of the sheet material 9 are disposed a plurality of securing means 11. Securing means 11 are at spaced-apart positions near the edges 10 of the sheet material, as shown in FIG. 1, e.g. every 3 to 6 feet apart, and these securing means secure the sheet material in a taut condition to the pool outer portions (e.g. copings 4 or deck 5 or supports), as shown in FIG. 1.

Anchor means 15 are disposed in the pool outer portions. A first anchor means 16 is shown, for illustration purposes, in the coping, a second anchor means 17 is shown, for illustration purposes, in the deck, and a third anchor means 18 is shown, for illustration purposes. However, normally, for a particular pool, all of the anchor means will be in either the coping or the deck or the supports, although the anchor means may be in the tracks or, when the tracks are disposed in favorable positions, the tracks may, at least in part, form the anchor means. The anchor means is attached to the securing means by an attachment means 20 in a manner to provide the taut condition of the sheet material, as described more fully below. While this taut condition can be provided by a number of different securing means or attachment means, most conveniently, that taut condition is provided by either the attachment means 20 being springs or the securing means being adjustable straps. Thus, for example, when opposite sides of pool cover 1 are stretched to attach the attachment means 20 to the securing means 11, and to the anchor means 15, spring attachment means will be engaged and cause a taut condition of the pool cover, when deployed over the pool, as explained more fully below.

The securing means 11 and the anchor means 15 will have suitable devices or configurations for connecting to the attachment means 20. While this may be almost any arrangement desired, conveniently a simple loop 21 (also see FIG. 3) is configured on the securing means, and a pin 46 (see FIG. 4) is provided on the anchor means.

At least one aperture 22 is disposed in the sheet material 9, and at least one aperture will be near a lowermost portion, generally 23, of the sheet material 9 when the sheet material is in the taut condition over the pool.

Figure 5:
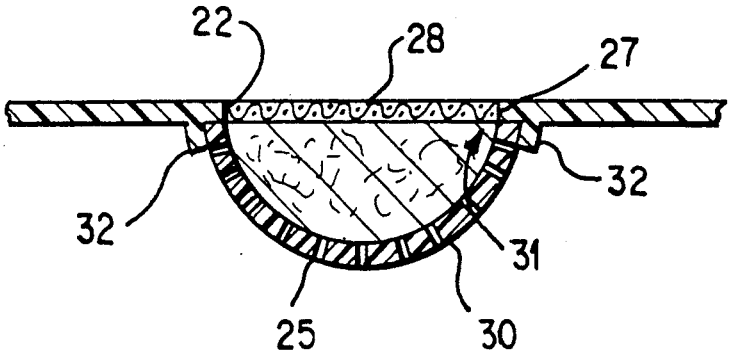
FIG. 5 is a cross section of FIG. 1, taken along the lines I—I.

A filter 25 is attached along and near peripheral edges, generally 27, of aperture 22 (also see FIG. 5). The filter has pore sizes sufficient to be impervious to silt or debris but pervious to water. Thus, silt and debris are prevented by the filter 25 from entering the pool, while water from snow or rain may enter the pool through filter 25, so as to keep the impervious sheet material 9 from being weighted down by such water and sinking under the surface of the water in the water-filled pool.

While not required, it is preferable that aperture 22 also have a mesh screen 28 (see FIG. 5) disposed thereover for removing large debris from the water entering the filter and preventing undue damage or clogging of the filter by such large debris. A polyester or olefin mesh is preferred.

The filter may either be a non-woven filter or a woven filter, but preferably the filter is in the form of a bag 30 (see FIG. 5) attached to the underside of the sheet material 9 and suspended below the aperture 22 with a mouth, generally, 31 of the bag 30 enclosing the peripheral edges 27 of aperture 22. The bag is attached by attachment 32 in any convenient manner, such as stitching, thermowelding and the like, but more preferably, the attachment of the bag is a releasable attachment, such as a zipper, such that the bag may be removed for easy cleaning, once the cover has been removed from the pool for storage during the Summer swimming season.

In order to ensure that the filter adequately filters silt and small debris, the pore size of the filter is not greater than about 300 microns, and more preferably not greater than about 200 microns. However, to ensure that even heavy flows of rain and melting snow pass through the filter, essentially unimpeded, the pore sizes of the filter should be at least about 100 microns, and, therefore, the preferred range of the pore sizes is between about 100 and 200 microns.

Turning back to FIG. 1, while not necessary, the sheet material may have more than one aperture and filter therein, and, as shown, for illustration purposes, in FIG. 1, a square aperture 34 or a rectangular aperture 35 may be included in the sheet material, along with appropriate screens and filters therefor, to ensure complete movement of water from rain or snow into any lowermost portion that may occur when the cover is in a less than fully taut condition, as explained below. Generally, however, no more than two apertures will ever be needed, although at least two apertures, e.g. three, four or more, may be used if so desired.

The apertures need not be of any critical size and, indeed, can be quite small. For example, the surface area of the aperture can be from as little as about 0.5 square foot to as much as about 5 square feet, for larger covers, but, more usually, that aperture will be more in the range of 1 to 3 square feet. For example, in a cover being 40 feet long and 20 feet wide, a circular aperture of about 1 foot to 2 feet in diameter is more than adequate.

The sheet material may be made of any water impervious material, such as rubberized canvas, and the like, but preferably the sheet material is a plastic, such as an olefin plastic, a vinyl plastic or a rubber. The sheet material may be reinforced with a reinforcing fibrous web, e.g. a polyester or olefin web, either attached to the sheet material or molded into the sheet material. However, since the sheet material is intended to support an adult in an emergency situation, such as an adult falling into the pool, the sheet material must be of substantial strength. For example, when the sheet material is a vinyl plastic, the weight of that vinyl sheet should be between about 5 and 20 ounces per square yard, in order to ensure adequate strength for such emergency situations.

Figure 2:
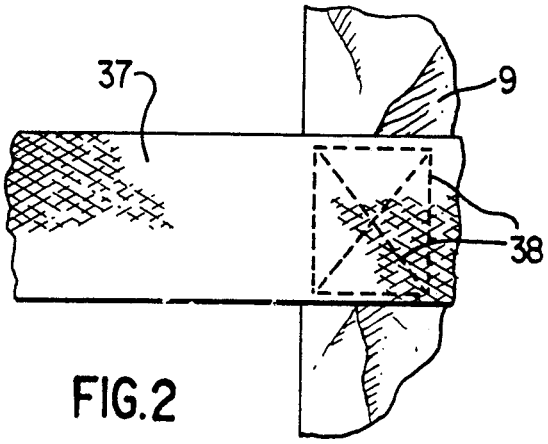
FIG. 2 is a detailed drawing of the attachment of the securing means to the sheet material.

Likewise, for such emergency situations, the securing means should be substantial. The securing means, therefore, are preferably woven straps 37 (see FIG. 2) which are attached to the sheet material in a well-anchored manner, such as where strap 37 is stitched to sheet material 9 by box stitches 38.

Also, to ensure security of the cover in emergency situations, the straps 37 are preferably extended straps which extend from an attached side of the sheet material to an opposite side of the sheet material and form the securing means at that opposite side, as shown in FIG. 1. The extended straps, therefore, form a support grid for the cover, also as shown in FIG. 1. Those extended straps may be on top of the sheet material 9, or underneath the sheet material 9, or both, as illustrated by strap 40, which is on top of the sheet material, and strap 41, which is underneath the sheet material, as shown in FIG. 1. With the arrangement shown in FIG. 1, the support grid is generally in a rectangular form, although other configurations of the extended straps for providing the support grid may be used.

Figure 3:
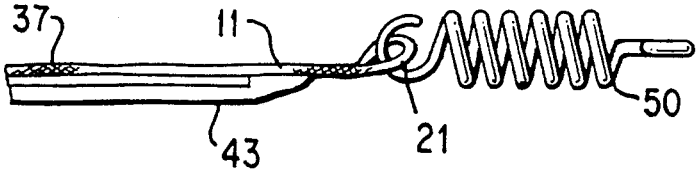
FIG. 3 is a side view of a securing means and an attachment means.

As also shown in FIG. 1, the underside of the extended straps 37 will lie at least on part of the coping 4 of the pool, and most preferably, as shown in FIG. 3, that underside of the extended strap 37 will have an abrasion-resistant material 43 thereon, e.g. a silicon polymer coating.

Figure 4:
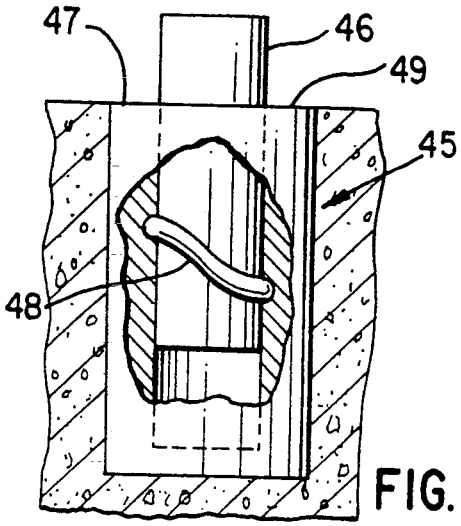
FIG. 4 is a side view, partially broken away, showing a suitable anchor for the present pool cover.

Any anchor means may be provided, as desired, but an anchor means such as that shown in FIG. 4 is preferred. Thus, in FIG. 4, the anchor means, generally 45, has an inner pin 46 which is lowerable into an outer part 47 by rotating inner pin 46 such that a follower and groove 48 or a screw thread will allow inner pin 46 to be raised for connecting the attachment means 20 or lowered when the pool cover 1 is not in place on the pool. When that anchor is buried into the pool outer portion, up to the point of about shoulder 49, inner pin 46 may be lowered into the anchor at the pool outer portion when not used for anchoring the cover and will be out of sight and will not cause a walking hazard. Of course, the anchor, as noted above, may be in the pool outer portions which are constituted by either the pool coping or the pool deck or the pool supports or a pool track.

As can be appreciated from the above, it is necessary for the aperture, with the attached filter, to be disposed at a lowermost portion of the sheet material 9, when that sheet material is deployed over the pool. That lowermost portion will occur at the lowest point of the natural sag of the sheet material when the sheet material is in a taut condition. The exact position of that lowermost portion, according to the natural sag, will depend upon the configuration of the sheet material 9. In the rectangular pool cover illustrated in FIG. 1, that lowermost portion will be approximately at the center of the width and the center of the length of the pool cover.

However, in non-regular pools, such as kidney-shaped pools and the like, that lowermost portion may occur at other places. However, generally speaking, that lowermost portion will occur at the greatest distance from side walls 3 of the pool in any direction from those side walls, and, therefore, a close estimate of the lowermost portion of the deployed sheet material can be obtained. Of course, as noted above, additional apertures 22 and filters 25 may be provided in the sheet material 9, to ensure free flow of water from rain and snow from the cover into the filter or filters.

As can also be appreciated from the above, the taut condition of the cover must be achieved when the cover is first deployed over the pool and during the entire time of such deployment. In this regard, "taut" is defined as sufficient stress in the cover that, when the cover is deployed over the pool and a natural drape has occurred, the lowermost portion or portions of the cover are spaced above the surface of the water in the pool. Of course, during the Winter, the level of the water in the pool will be slightly less than the level maintained during the swimming season, i.e. at least 4 to 6 inches less but not more than about one to one and one-half feet below that swimming level. However, that level can change from time to time.

Further, when the cover is first deployed over the pool, the taut condition which is first achieved is somewhat relaxed, with time, as the stress in the cover causes some stretching thereof. Similarly, the amount of such stretching will vary with ambient air temperatures.

For the above reasons, the amount of stress applied to the cover, which results in the taut condition, must be adjustable. That stress may be adjusted by adjusting the length of the securing means, e.g. the straps, or the distance of the anchor means from the edges of the cover, although this latter adjustment is not convenient. Adjusting the lengths of the securing means, e.g. by adjusting conventional strap clamps or buckles, is convenient to keep the cover under stress, but a preferred means is to adjust the attachment means between the anchor means and the securing means. This is especially true since the attachment should be resilient to accommodate varying stresses in the cover as ambient temperature changes, e.g. resilient attachment means such as rubber straps and springs.

Figure 6:
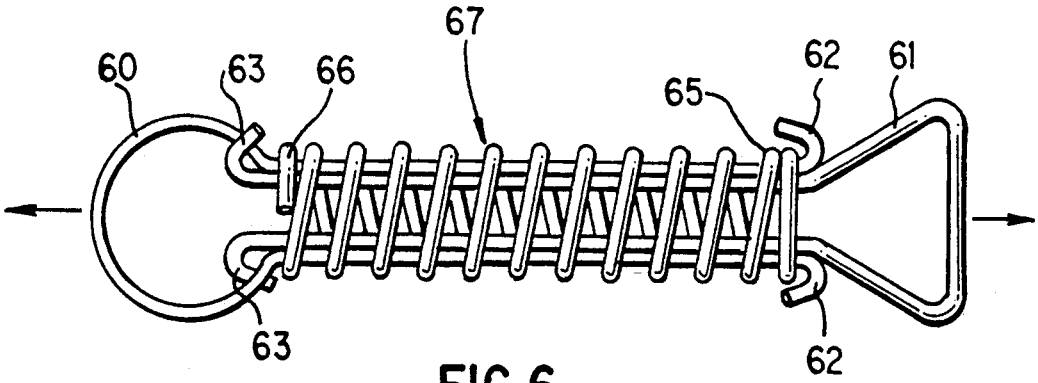
FIG. 6 is a side view of a preferred attachment means, i.e. a particular compression spring.

The attachment means may be a conventional adjustable tension spring 50, as shown in FIG. 3. These springs are known in the art and need not be described herein for sake of conciseness. However, basically, the tension imposed by the spring is adjustable, and, hence, as the stress on the cover, for example, relaxes due to relaxation over time or with higher ambient temperature, the stress in the cover may be increased by adjusting the spring to ensure continuation of the taut condition. Alternatively, the spring may be a compression-type, tension spring as shown in FIG. 6. In this type of spring, the connecting ends 60 and 61, when under tension, as shown by the arrows, cause respective hooks 62 and 63 to engage the outer parts 65 and 66, respectively, of spring 67 to cause compression of spring 67. The compression of the spring, rather than the elongation of the spring, makes the spring more uniform and reliable in the force exerted over a longer period of time to ensure a more constant taut condition and, as such, is a preferred embodiment. As noted above, however, the taut condition may be adjusted by the securing means, e.g. strap with conventional length adjusting buckles and clamps, and this is the preferred embodiment. In this case, the attachment means need only be a resilient attachment means, such as shown in FIG. 6, and need not be adjustable.

Having described the invention, it is apparent that modifications of the specific embodiments described herein will be apparent to those skilled in the art, and it is intended that those modifications be embraced by the spirit and scope of the annexed claims.

What is claimed is:

1. A swimming pool cover for covering the entire area of a water-filled pool so as to prevent egress of silt and debris into the pool during periods of non-use of the pool, comprising:

(1) a water-impervious sheet material configured to extend across the entire area of the pool;

(2) securing means attached at spaced-apart positions near edges of the sheet material for securing the sheet material in a taut condition to pool outer portions, said taut condition being such that when the cover is deployed over the pool and a natural drape of the cover has occurred, a lowermost portion of the cover is spaced from water in the pool;

(3) anchor means disposed in said pool outer portions for anchoring said securing means in a manner to provide said taut condition of the sheet material;

(4) resilient attachment means for attaching said securing means to said anchor means so as to ensure the maintenance of the taut condition;

(5) at least one aperture disposed in said sheet material with at least one said aperture being at the lowermost portion of the sheet material when the sheet material is in said taut condition; and (6) a filter in the form of a bag attached along and near peripheral edges of the said aperture and suspended below said aperture with a mouth of the bag enclosing the peripheral edges of the aperture and said filter having pore sizes sufficient to be impervious to silt and debris but pervious to water such that silt and debris are prevented to the filter from entering the pool while water from snow or rain may enter the pool through said filter so as to keep the imperious sheet material from being weighted down by such water and sinking under the surface of water in a water-filled pool.

2. The cover of claim 1 wherein the aperture also has a screen disposed thereover for preventing larger debris from water entering the filter.

3. The cover of claim 1 wherein the filter is a non-woven filter or a woven filter.

4. The cover of claim 3 wherein the bag is attached to the underside of the sheet material.

5. The cover of claim 3 wherein the filter has pore sizes of not greater than about 300 microns.

6. The cover of claim 5 wherein the pore sizes are not greater than about 200 microns.

7. The cover of claim 6 wherein the pore sizes are between 100 and 200 microns.

8. The cover of claim 1 wherein at least two apertures are disposed in said sheet material.

9. The cover of claim 1 wherein the sheet material is a plastic.

10. The cover of claim 9 wherein the plastic is an olefin, a vinyl or a rubber.

11. The cover of claim 10 wherein the plastic is a vinyl of a weight of between 5 and 20 ounces per square yard.

12. The cover of claim 1 wherein the securing means are straps which are attached to said sheet material.

13. The cover of claim 1 wherein the securing means are adjustable.

14. The cover of claim 13 wherein the straps form a support grid for said cover.

15. The cover of claim 14 wherein the support grid is generally rectangular.

16. The cover of claim 13 wherein undersides of the straps which lie at least on a coping of the pool have an abrasion-resistant material thereon.

17. The cover of claim 13 wherein the securing means are adjustable straps.

18. The cover of claim 1 wherein said anchor means is lowerable into said pool outer portions when not used for anchoring said cover.

* * * * *